United States Patent [19]

McKeown et al.

[11] 4,068,146

[45] Jan. 10, 1978

[54] CHARGED PARTICLE BEAM DEFLECTOR

[75] Inventors: Joseph McKeown; John S. Fraser; Stanley O. Schriber, all of Deep River, Canada

[73] Assignee: Atomic Energy of Canada Limited, Ottawa, Canada

[21] Appl. No.: 746,136

[22] Filed: Nov. 30, 1976

[30] Foreign Application Priority Data

May 17, 1976 Canada ..... 252696

[51] Int. Cl.[2] ..... H01J 25/22

[52] U.S. Cl. ..... 315/5.26; 313/421; 315/5.24

[58] Field of Search ..... 315/5.24, 5.25, 5.26, 315/5.27, 5.28, 5.29, 3, 4, 5, 39; 313/421

[56] References Cited

U.S. PATENT DOCUMENTS

| | | | |
|---|---|---|---|
| 2,275,480 | 3/1942 | Varian et al. | 315/5.25 |
| 3,022,236 | 2/1962 | Ulrich et al. | 315/39 X |
| 3,442,758 | 5/1969 | Penfold et al. | 315/39 X |
| 3,482,139 | 12/1969 | Leboutet et al. | 315/5.25 |
| 3,609,448 | 9/1971 | Williams | 315/39 |

*Primary Examiner*—Saxfield Chatmon, Jr.
*Attorney, Agent, or Firm*—Edward Rymek

[57] ABSTRACT

A charged particle beam deflector having a bimodal resonant cavity through which a charged particle beam is passed along the cavity axis. The cavity is excited in a first mode by applying a first rf signal to the cavity through a first magnetic feed loop on the side of the cavity, and in a second mode orthogonal to the first mode by applying a second rf signal to the cavity through a second magnetic feed loop located on the side of the cavity at a circumferential angle of approximately 90° from the first feed loop. The first mode deflects the beam along a first diametric axis passing through the cavity axis and the first loop location and the second mode deflects the beam along a second diametric axis which is substantially perpendicular to the first diametric axis. The rf signals to the feed loops are normally of identical frequency but may differ in ampitude and in phase from one another or from the beam to provide various controlled scan patterns.

9 Claims, 6 Drawing Figures

CHARGED PARTICLE BEAM DEFLECTOR

This invention is directed to a charged particle beam deflector and in particular to a deflector including a bimodal cavity resonator.

In a reference by J. Haimson, Proceeding 1966 Linear Acceleration Conference, LASL, LA-3609, it has been proposed that a cavity resonator may be used as a beam deflector in a beam chopper by exciting the cavity at a particular mode and passing the beam through the cavity along its central axis. The electric and magnetic field distribution within the cavity is such that strong transverse magnetic fields are set up along the central axis. Thus driving the cavity with rf power from an rf source at the $TM_{110}$ mode frequency provides the energy required to displace the charged particle beam. The displacement direction is normal to the magnetic fields in the cavity and therefore is along only one axis for each cavity used.

Conventional magnet systems on the other hand are capable of deflecting a beam in both the horizontal and vertical directions, but require external dc power supplies and are subject to coil insulation problems.

It is therefore an object of this invention to provide a charged particle beam deflector for deflecting a beam along perpendicular axes.

It is a further object of this invention to provide a beam deflector which is simple to construct and operate.

These and other objects are achieved in a charged particle beam deflector which includes a bimodal resonant cavity with beam holes concentric with the cavity axis to allow the passage of the particle beam, to be deflected, through the cavity. A first mode is excited in the cavity by applying a first rf signal to a first rf feed means located on the side of the cavity and a second mode, orthogonal to the first is excited in the cavity by applying a second rf signal to a second rf feed means located on the side of the cavity at an angle of approximately 90° to the first feed means. The orthogonal modes are further tuned to the same frequency such as by capacitive tuning screws located at the electric field maxima of the cavity. The beam is deflected as it passes through the cavity, along a first diametric axis passing through the first feed location due to the magnetic field in the first mode and along a second diametric axis perpendicular to the first diametric axis due to the magnetic field in the second mode. The beam will therefore be scanned through controlled patterns depending on the relationship between the phases and amplitudes of the feed signals between themselves and/or the particle beam as well as the relationship between the frequency of the feed signals and the frequency of the particle beam.

Any departure from azimuthal symmetry in a cavity represents a perturbation to the cavity fields causing modes to split into components having similar field patterns but different resonant frequencies.

Figure 1:
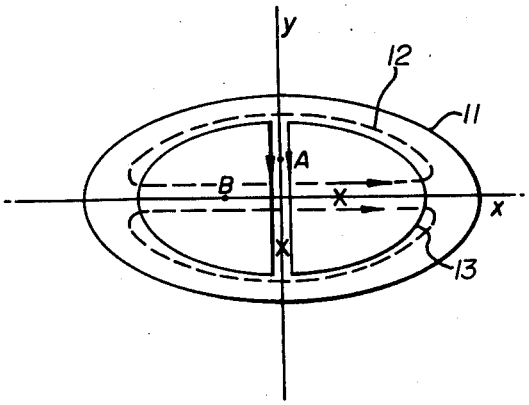
FIG. 1 PRIOR ART
FIG. 1 illustrates the breakup of the $TM_{110}$ mode in an elliptical cavity.

As described in the reference: Chu, L. J., Journal of Applied Physics 9 (1938) 583, Chu has shown that for an elliptical cavity, modes with azimuthal asymmetry in their field distributions will break up into two orthogonal component modes having different resonant frequencies. Orientation of typical magnetic field lines 12 and 13 for the two orthogonal $TM_{110}$-like modes in an elliptic cavity 11 are represented in FIG. 1. The figure shows that magnetic field lines 12 and 13 close to the axis of the cavity 11 orient themselves along the major or x-axis and minor or y-axis respectively.

Maximum electric field positions for the two orthogonal modes occur at positions A and B respectively. Using the criteria published by Slater in the reference: Slater, J. C., Microwave Electronics Van Nostrand, Princeton, N.J., (1950) p. 81: it is possible to introduce a tuning plunger at positions A and B which will lower the resonant frequency of each mode independently. This principle has been used in paramagnetic resonance studies in diamond to continuously split the degenerate $TM_{110}$ modes on a right circular cylinder over a continuous frequency range, as described in the reference: Sorokin, P. P. et al, Physical Review 118, No. 4 (1960) pages 939 to 945.

Figure 2:
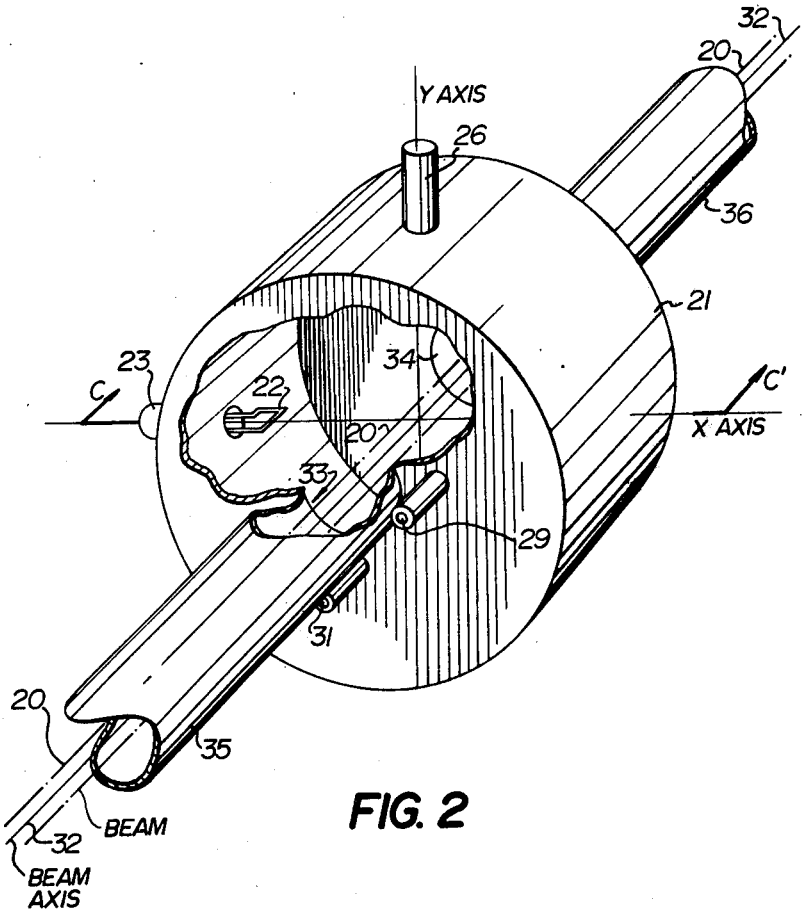
FIG. 2 illustrates a charged particle beam deflector in accordance with this invention.
Figure 3:
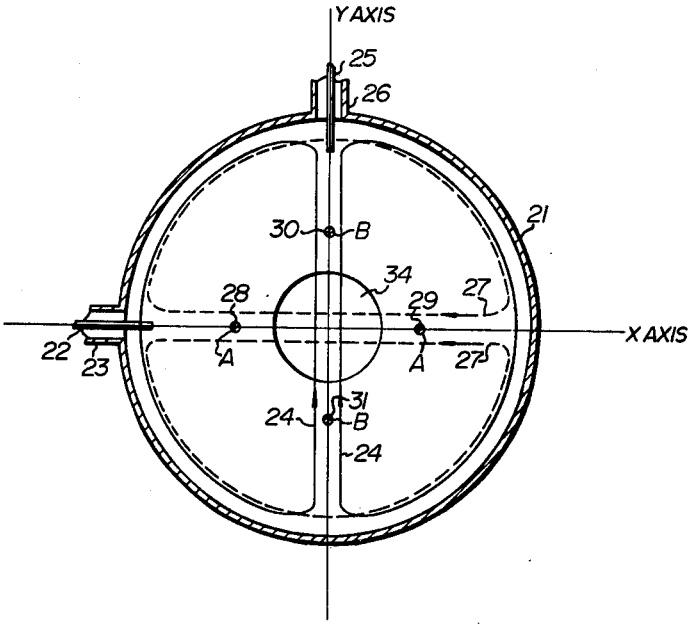
FIG. 3 illustrates a cross-section of the deflector in FIG. 2.

FIGS. 2 and 3 illustrate an embodiment of an apparatus in accordance with this invention for deflecting a charged particle beam 20. The deflector uses a resonant right circular cavity 21 in which non-coupled orthogonal fields may be excited. These fields then can be controlled to deflect a beam 20 across an *x-y* plane in the *x* and/or *y* directions. The beam deflector includes a first rf magnetic coupling feed loop 22 mounted in the circumferential surface of cavity 21 within a housing 23 by which the cavity may be excited in a first mode having a magnetic field distribution represented by lines 24. The housing 23 maintains the vacuum integrity of the cavity 21. A second *rf* magnetic coupling feed loop 25 is also mounted in the circumferential surface of cavity 21 within a housing 26 by which the cavity may be excited in a second mode orthogonal to the first mode. In order to maintain uncoupled orthogonal modes, loop 25 is located circumferentially at an angle of 90° from loop 23, loop 23 being shown on the *x*-axis and loop 25 being shown on the *y*-axis. The magnetic field distribution of the second orthogonal mode is represented by lines 27.

The orthogonal modes 24 and 27 produce maximum electric field positions A and B respectively at which points tuning screws 28, 29, 30 and 31 are inserted into the cavity 21. These maxima positions are symmetrically located on the x and y axis about the centre axis 32 of the cavity at a distance of approximately 0.44 R where R is the distance from the centre axis 32 to the cavity wall. These tuning screws 28, 29, 30 and 31 may be stainless steel capacitive tuning screws that are mounted through glass windows to protect the vacuum integrity of the cavity 21. The tuning screws are used to tune the two orthogonal modes 24 and 27 to the same frequency.

The cavity 21 further includes beam holes or apertures 33 and 34 which are concentric with the centre axis 32 to permit the passage of the charged particle beam 20. The cavity 21 may be connected to a beam source such as an accelerator by of a beam pipe 35 and to a utilization means by a second beam pipe 36 to maintain the vacuum integrity of a system.

Figure 4:
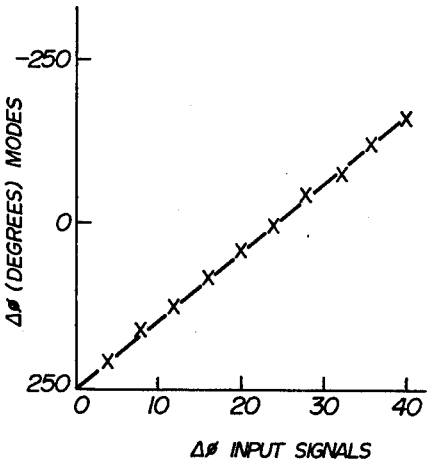
FIG. 4 is a plot of the phase difference between the orthogonal mode with respect to the phase difference of the feed signals.
Figure 5:
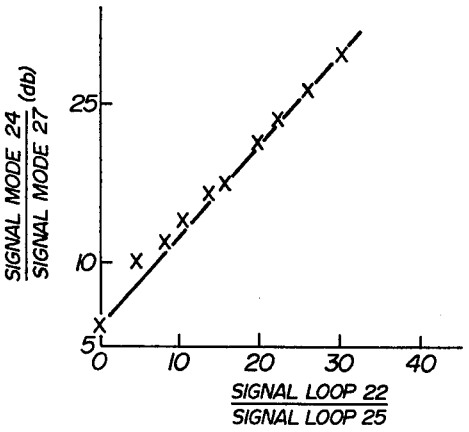
FIG. 5 is a plot of the ratio of the amplitudes of the modes with respect to the ratio of the amplitudes of the feed signals.

It has been determined that for an apparatus as described above isolation, between the two orthogonal modes 24 and 27 resonant at the same frequency, was greater than 40 db. Also, the relative phase between the modes 24 and 27 could be continuously varied over the full 360° range. This is shown in FIGS. 4 and 5. In FIG. 4, the phase difference between the orthogonal modes 24 and 27 is plotted against the phase difference between the input signals to feed loops 22 and 25. It can be seen that the phase difference between the modes varies directly and linearly with the phase difference between the input signal over the entire range of $0 \leqq \phi \leqq 360°$. In FIG. 5, the ratio of the mode amplitudes is plotted against the ratio of the amplitudes of the input signals to feed loops 22 and 25, and again it can be seen that the fields 24 and 27 vary directly and linearly with the input signals showing that cross coupling does not take place in the cavity 21.

In operation, the beam 20 to be deflected will be made to enter the cavity 21 through pipe 35 along the centre axis 32. If neither of the orthogonal modes 24 and 27 are excited in the cavity 21, the beam 20 will pass through the cavity 21 without deflection.

Figure 6:
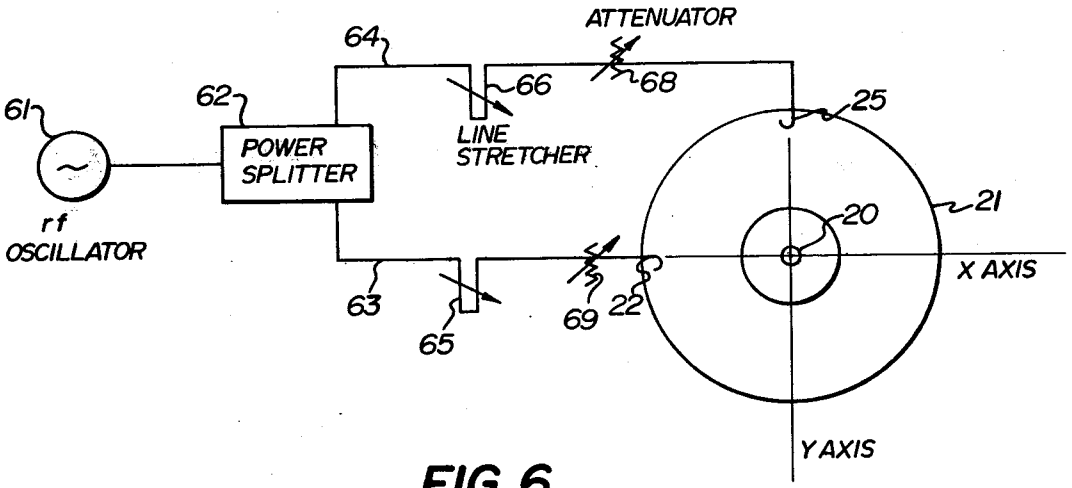
FIG. 6 illustrates a drive circuit for generating feed signals for the beam deflector.

One circuit which may be used to drive the beam deflector in accordance with this invention is shown in FIG. 6. It includes an *rf* oscillator 61, the output signal of which is adjusted to a desired amplitude at the resonant frequency of the cavity 21. Oscillator 61 may oscillate at a frequency different from the beam 20 frequency or at the same frequency as the beam frequency. In the latter case oscillator 61 may be the rf oscillator used to drive the beam 20 accelerating apparatus. The oscillator 61 output signal is divided by a power splitter 62 which feeds feed loops 22 and 25 through lines 63 and 64 respectively. Each line 63 and 64 further includes a line stretcher 65 and 66 respectively such that the relative phase of the signals to feed loops 22 and 25, may be varied or adjusted with respect to one another as well as with respect to the beam 20. Each line also includes an attenuator 67 and 68 respectively such that the relative amplitudes of the signals to the loops 22 and 25, may be varied or adjusted.

With an *rf* signal applied to feed loop 22, the beam 20 passing through the cavity 21 will be scanned back and forth along the *x*-axis once during every cycle of the *rf* signal, the amplitude of the scan being directly related to amplitude of the signal at loop 22. Similarly, with an *rf* signal applied to feed loop 25, the beam 20 will be scanned back and forth along the *y*-axis. Thus, by applying signals to both loops simultaneously, the beam will be scanned in closed patterns, the shapes of which will depend on the relative phases and amplitudes of the signals.

The beam deflector in accordance with this invention finds advantageous use in several high power beam deflector applications. The deflector may be used to scan a charged particle beam across an aperture to provide a chopped beam. If the scan frequency is half of the beam frequency, the chopped beam will have a frequency of half the original beam frequency. The deflector may also be used as a beam phase selective element by scanning the beam across a narrow aperture. As the phase of the input signals to the deflector is varied, a different portion of the beam cycle will pass through the aperture. Such a device may be used for longitudinal beam analysis or to vary the power of an output beam. Finally, the deflector may be used as a programmable beam steerer with the drive signals frequency or the cavity resonant frequency different from the principal frequency of the beam.

We claim:

1. A charged particle beam deflector comprising:

bimodal resonant cavity means having beam holes concentric with the cavity axis to allow the passage of the particle beam through the cavity means;

first feed means mounted on the side of the cavity means to feed a first rf signal into the cavity means to excite the cavity means in a first mode or deflecting the particle beam along a first diametric axis passing through the cavity axis and feed means location;

second feed means mounted on the side of the cavity and located at an angle of approximately 90° from the first feed means, to feed a second rf signal into the cavity means to excite the cavity means in a second mode orthogonal to the first mode for deflecting the particle beam along a second diametric axis which is substantially perpendicular to the first diametric axis; and tuning means mounted on the cavity means for tuning the orthogonal modes to the same frequency.

2. A beam deflector as claimed in claim 1 wherein said tuning means includes four capacitive tuning screws positioned at the electric field maxima of the orthogonal modes.

3. A beam deflector as claimed in claim 1 wherein the cavity means consists of a right circular cavity.

4. A beam deflector as claimed in claim 1 wherein the cavity means consists of right circular cavity resonant at the particle beam frequency.

5. A beam deflector as claimed in claim 1 wherein the cavity means consists of a right circular cavity resonant at a harmonic of the particle beam frequency.

6. A beam deflector as claimed in claim 1 wherein each of the first and second feed means includes a magnetic coupling feed loop.

7. A beam deflector as claimed in claim 1 which further includes rf source means coupled to the first and second feed means for providing independent rf signals having the same frequency, to the first and second feed means.

8. A beam deflector as claimed in claim 7 wherein the rf source means include:

oscillator means for generating a signal of frequency equal to the frequency of the resonant cavity means;

power splitter means coupled to said oscillator means and for providing first and second output rf signals to be coupled to the first and second feed means, respectively;

first phase shifting means and first attenuator means serially connected between the power splitter means first output and the first feed means for shifting the phase and attenuating the amplitude of the rf signal coupled to the first feed means with respect to the rf signal coupled to the second feed means.

9. A beam deflector as claimed in claim 8 wherein the rf source means further includes second phase shifting means and second attenuator means serially connected between the power splitter means second output and the second feed means for shifting the phase and attenuating the amplitude of the rf signal coupled to the second feed means with respect to the rf signal coupled to the first feed means, and for shifting the phase of the rf signal coupled to the second feed means with respect to the phase of the particle beam.

* * * * *